US009035842B2

(12) United States Patent
Tahmisian, Jr. et al.

(10) Patent No.: US 9,035,842 B2
(45) Date of Patent: May 19, 2015

(54) MINIATURE HORN INTERROGATOR ANTENNA WITH INTERNAL SUM/DIFFERENCE COMBINER

(75) Inventors: Theodore N. Tahmisian, Jr., Columbia City, IN (US); Charles A. Hall, Fort Wayne, IN (US)

(73) Assignee: RAYTHEON COMPANY, Waltham, MA (US)

( * ) Notice: Subject to any disclaimer, the term of this patent is extended or adjusted under 35 U.S.C. 154(b) by 228 days.

(21) Appl. No.: 13/445,794

(22) Filed: Apr. 12, 2012

(65) Prior Publication Data

US 2013/0271334 A1 Oct. 17, 2013

(51) Int. Cl.

| | |
|---|---|
| ***H01Q 13/00*** | (2006.01) |
| ***H01Q 13/02*** | (2006.01) |
| ***H01Q 25/02*** | (2006.01) |
| ***H01P 5/20*** | (2006.01) |

(52) U.S. Cl.

CPC ..... *H01Q 13/0266* (2013.01); *H01Q 25/02* (2013.01); *H01P 5/20* (2013.01)

(58) Field of Classification Search

USPC ..... 343/772, 776, 786

See application file for complete search history.

(56) References Cited

U.S. PATENT DOCUMENTS

| | | | | |
|---|---|---|---|---|
| 3,212,096 A | | 10/1965 | Schuster et al. | |
| 3,274,604 A | * | 9/1966 | Lewis | 343/786 |
| 3,883,877 A | | 5/1975 | Chabah et al. | |
| 4,897,663 A | * | 1/1990 | Kusano et al. | 343/786 |
| 5,574,412 A | * | 11/1996 | Nilsson | 333/122 |
| 6,864,850 B2 | * | 3/2005 | Imaizumi et al. | 343/776 |
| 2009/0267852 A1 | * | 10/2009 | Tahmisian et al. | 343/776 |
| 2011/0063102 A1 | | 3/2011 | Ivtsenkov et al. | |

FOREIGN PATENT DOCUMENTS

| | | |
|---|---|---|
| EP | 0 101 533 A1 | 2/1984 |
| EP | 0 421 757 A2 | 4/1991 |

OTHER PUBLICATIONS

Ishihara, "Broad-Band Matched Magic Tees", Electronics and Communications in Japan, vol. 46, No. 5, May 1, 1963 (pp. 18-23).

Loth, "Recent Advances in Waveguide Hybrid Junctions", IRE Transactions on Microwave Theory and Techniques, vol. MMT-4, No. 4, Oct. 1, 1956 (pp. 268-271).

(Continued)

*Primary Examiner* — Sue A Purvis
*Assistant Examiner* — Hai Tran
(74) *Attorney, Agent, or Firm* — Christie, Parker & Hale, LLP

(57) ABSTRACT

A miniature interrogator antenna assembly including: a housing; a first miniature horn antenna in the housing having a first aperture; a second miniature horn antenna in the housing having a second aperture. The first and second miniature horn antennas are arranged in a canted configuration and are joint at a front of the assembly to form combined apertures at the front of the assembly. The antenna assembly further includes: a splitter/combiner having a matching portion, where the matching portion is positioned in the housing in such a way that an apex of the matching portion points to the front of the assembly; a plurality of annular grooves formed around the combined apertures at the front of the assembly; a sum input port coupled to a first waveguide with an H-plane bend feeding the splitter/combiner; and a difference input port coupled to a second waveguide feeding the splitter/combiner directly.

20 Claims, 9 Drawing Sheets

(56) References Cited

OTHER PUBLICATIONS

Written Opinion of the International Searching Authority for International Application No. PCT/US2013/023493, filed Jan. 28, 2013, Written Opinion of the International Searching Authority mailed Apr. 19, 2013 (6 pgs.).

International Search Report for International Application No. PCT/US2013/023493, filed Jan. 28, 2013, International Search Report dated Apr. 12, 2013 and mailed Apr. 19, 2013 (4 pgs.).

* cited by examiner

MINIATURE HORN INTERROGATOR ANTENNA WITH INTERNAL SUM/DIFFERENCE COMBINER

FIELD OF THE INVENTION

The present invention relates to antennas and more specifically to a miniature horn interrogator antenna with internal sum/difference combiner that includes side-lobe suppressors.

BACKGROUND

Combat identification (or CID) is referred to as the process of attaining an accurate characterization of targeted and detected objects in a battlespace. Depending upon the situation, such a characterization may be limited to identification of an object with an identifier such as "friend," "enemy," or "unknown." In other combat or non-combat situations, other characterizations, such as class, type, nationality, and mission configuration may be used along with appropriate identifiers. Such identification processes are sometimes carried out via combat identification systems at millimeter wave (mmW) frequencies (Ka band) and typically use an interrogator antenna system which includes a directive antenna made up of an array of antenna elements. Such interrogator array antenna systems are relatively large and heavy and therefore are not generally suitable for use on relatively light weaponry or equipment such as those which may be carried by a soldier, a hiker, or the like. As a result, these combat identification systems are typically deployed on large equipment, such as tanks and other large vehicular weapons platforms that can support this rather large and heavy equipment.

One way to reduce the size and weight of the interrogator antenna is to reduce the number of antenna elements which make up the directive antenna array. The problem with this approach is that by reducing the number of antenna elements in an array, the electrical aperture dimensions of the array antenna are correspondingly reduced in size. This in turn, leads to larger azimuth discrimination angles which undermine specific object targeting.

Moreover, since ID antenna systems require high directivity and gain, the beam forming electronic circuitry required by these types of ID antenna systems makes them inefficient due to signal losses incurred by the time phased differences necessary for the several linear radiating elements of such arrays. Horn antennas generally have high directivity and gain. However, horn antennas, configured in a small antenna system, are susceptible to a number of unwanted grating lobes in the antenna wave patterns which is reduced when compared with the number of grating lobes that would result from use of linear antenna element arrays. Canting the sectored horns used to generate both the sum and difference patterns further suppresses grating lobes.

Accordingly, there is a need for a small and light interrogator antenna with minimum or no side-lobes that can extend CID capability to the dismounted soldier or individual.

SUMMARY

The two horn interrogator antenna elements of the present invention has a small physical and electrical aperture than conventional array antennas. However, the electrical performance characteristics of the two horn interrogator antenna of the present invention are substantially equal to the electrical performance characteristics of conventional interrogator antenna systems while at the same time having a much smaller size and weight than the conventional interrogator antenna systems.

In some embodiments, the present invention is a miniature interrogator antenna assembly, which includes: a housing; a first miniature horn antenna in the housing having a first aperture; a second miniature horn antenna in the housing having a second aperture. The first and second miniature horn antennas are arranged in a canted configuration and are joined at a front of the assembly, and the first and second apertures form combined apertures at the front of the assembly. The interrogator antenna assembly further includes: a splitter/combiner having a matching portion, wherein the matching portion is positioned in the housing in such a way that an apex of the matching portion points to the front of the assembly; a plurality of annular grooves formed around the combined apertures at the front of the assembly; a sum input port coupled to a first waveguide with an H-plane bend feeding the splitter/combiner; and a difference input port coupled to a second waveguide feeding the splitter/combiner directly. The miniature interrogator antenna assembly is configured to transmit a sum pattern or a difference pattern depending of which input port is selected.

In some embodiments, the present invention is a miniature interrogator antenna assembly, which includes: a housing; a first miniature horn antenna in the housing having a first aperture; a second miniature horn antenna in the housing having a second aperture. The first and second miniature horn antennas are arranged in a canted configuration and are joined at a front of the assembly, and the first and second apertures form combined apertures at the front of the assembly. The interrogator antenna assembly further includes a splitter/combiner having a matching portion, wherein the matching portion is positioned in the housing in such a way that an apex of the matching portion points to the front of the assembly; a sum input port coupled to the splitter/combiner; and a difference input port coupled to the splitter/combiner directly. The antenna assembly has a volume of less than 1.15 Cu. in., and the miniature interrogator antenna assembly is configured to transmit a sum pattern or a difference pattern depending of which input port is selected.

In some embodiments, the housing may be substantially in a shape of a cube and the antenna assembly may be molded in plastic, wherein the plastic is metalized. The interrogator antenna assembly may further include a first output port on a first side of the splitter/combiner and a second output port on a second side of the splitter/combiner opposite to the first side, wherein the first and second apertures are respectively coupled to the first and second output ports of the combiner via waveguides with an E-plane 90 degree bend.

BRIEF DESCRIPTION OF THE DRAWINGS

A more complete appreciation of the present invention, and many of the attendant features and aspects thereof, will become more readily apparent as the invention becomes better understood by reference to the following detailed description when considered in conjunction with the accompanying drawings in which like reference symbols indicate like components, wherein.

DETAILED DESCRIPTION

The present invention will now be described more fully with reference to the accompanying drawings, in which exemplary embodiments thereof are shown. The invention may, however, be embodied in many different forms and should not be construed as being limited to the embodiments set forth herein. Rather, these embodiments are provided so that this disclosure is thorough and complete, and will fully convey the concept of the present invention to those skilled in the art.

In some embodiments, the present system is a miniature horn interrogator antenna with internal sum/difference combiner that includes side-lobe suppressors. The miniature horn interrogator antenna has broad applicability in various fields including CID, police force, ground and air communications, simulation and training, personnel recovery, and the like. The antenna assembly has a very small form factor, that is, about the size of an ice cube, allowing it to be mounted in various configurations including directly on an individual's weapon, or other personal equipment.

In some embodiments, the miniature antenna assembly uses a canted sum-difference horn arrangement combined with an integral hybrid combiner to produce sum-difference radiation patterns. Furthermore, the antenna includes annular grooved rings about the aperture for preventing unwanted surface currents from flowing on the outside surfaces of the antenna assembly thereby suppressing side and back lobe radiations. In some embodiments, the miniature antenna assembly is capable of integration with millimeter RF transceivers, such as milli-meter wave Ka band transceivers.

In some embodiments, the miniaturized antenna of the present invention provides a dismounted soldier with combat identification capability. The soldier is now able to interrogate targets to determine if they are friendly (by receiving a transponder response) or not (no response). The antenna is reduced in size enabling integration with interrogator circuitry. The miniaturized antenna and associated interrogator transmit/receive circuitry designed to have low cost manufacturability.

Figure 1A:
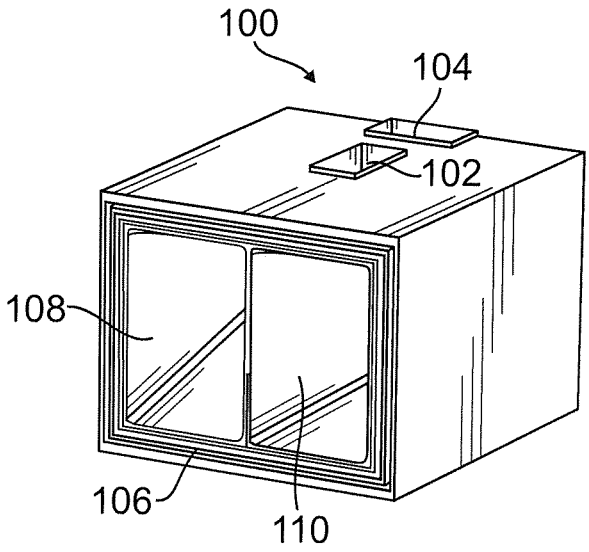
FIG. 1A is an exemplary front perspective view of a miniature antenna assembly, according to some embodiments of the present invention.

FIG. 1A is a front perspective view of a miniature antenna assembly, according to some embodiments of the present invention. As shown, in these embodiments, the antenna assembly 100 is substantially in the shape of a cube. That is, the assembly is formed within a cube-like housing, in these embodiments. Two miniaturized horn antennas with apertures 108 and 110 respectively, are formed in a canted manner inside the cube. The miniature horn antennas are arranged in an offset manner to suppress unwanted grating lobes. The input to the antenna uses two ports 102 and 104. Two input ports 102 and 104 are placed adjacent to each other on the top of the assembly 100.

Figure 1B:
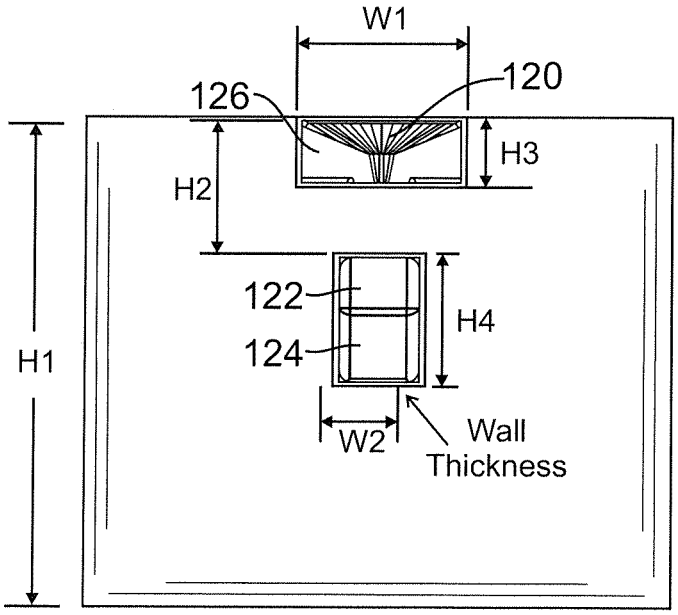
FIG. 1B is a top view showing portions of the internal structure of a miniature antenna assembly, according to some embodiments of the present invention.

FIG. 1B is a top view showing portions of the internal structure of a miniature antenna assembly, according to some embodiments of the present invention. As depicted, the matching portion of a splitter-combiner, also known as a "Magic-T" 120 is placed inside the antenna assembly. The internal splitter-combiner enables a sum radiation pattern or a difference radiation pattern, depending on the antenna drive port selected. A port-switched RF output from the transceiver is directed to the appropriate antenna input port 126 or 124. Each antenna input port accepts the identical transceiver waveform. Depending on the port selected by the transceiver, the antenna radiates either a sum or difference pattern. In this configuration, the top input port 126 is the difference port and the middle input port 124 is the sum port. Item 122 is the slanted portion of the right angle H-plane bend in the sum port. (See, for example, 230 of FIG. 2C, also 308 of FIG. 3A).

As shown in FIG. 1B, W1 is the width and H3 is the height of the difference input port (See, for example, 104 in FIG. 1A). Similarly, W2 is the width and H4 is the height of the sum input port 124. The top edge of the sum input port 124 is distanced from the closest edge of the difference port by H3 and from the back edge of the assembly by H2. It is noted that all the internal waveguides (discussed below) have the dimensions W1/H4 (W1=H4) and W2/H3 (W2=H3), regardless of their length. In some embodiments, the shortest waveguide dimension (W2/H3) contains the transverse E-field vector. (transverse to the shortest waveguide dimension).

In some embodiments, the dimension of an exemplary miniature antenna assembly are:

W1=7.62 mm, H1=28 mm, H2=7.78 mm, H3=4.06 mm, H4=7.62 mm, and W2=4.06 mm.

Figure 1C:
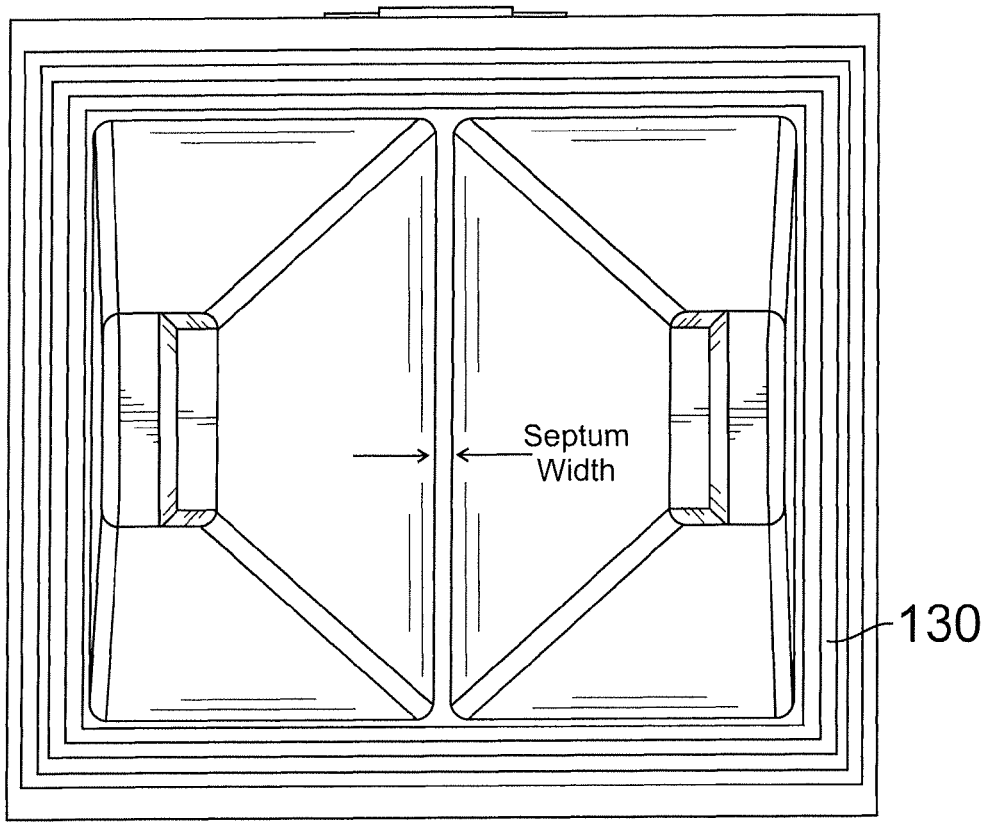
FIG. 1C is a front (aperture side) view of a miniature antenna assembly, according to some embodiments of the present invention.

FIG. 1C is a front (aperture side) view of a miniature antenna assembly, according to some embodiments of the present invention. A plurality of annular grooved rings 130 (two in this example) are formed around the combined horn apertures. These grooved rings 130 (grooves) prevent unwanted surface currents from flowing on the outside surfaces of the antenna assembly thereby suppressing side and back lobe radiations. The annular grooves are typically one-quarter wavelength deep and are positioned around the perimeter of the antenna's aperture to prevent internal surface currents from spreading to outside surfaces that would otherwise cause unwanted side-lobe radiation and distort the desired radiation pattern.

In some embodiments, the grooves 130 are spaced from the horns by 0.50 mm with a spacing of 0.5 mm, and have a depth of one-quarter of the wavelength, that is, about 2.0 mm in this example. In some embodiments, the septum width, that is, the combined width of the two adjacent walls of the two how antennas at the place where they come together is about 0.5 mm.

Figure 2A:
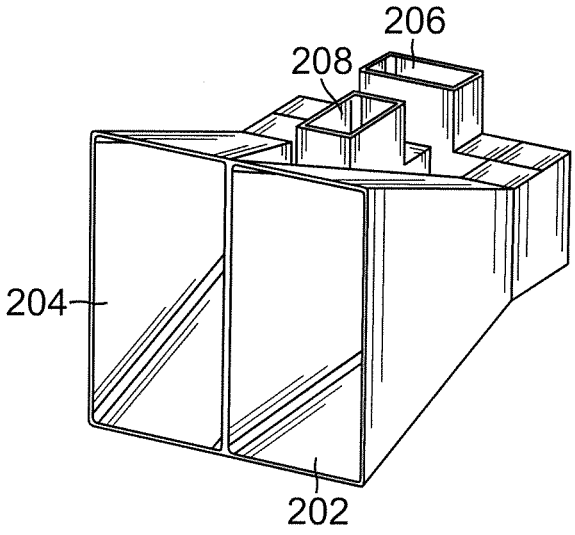
FIG. 2A is a simplified front perspective view of two canted miniature antennas and the associated waveguide and porting structure, according to some embodiments of the present invention.

FIG. 2A is a simplified front perspective view of two canted miniature antennas and the associated waveguides and porting structure, according to some embodiments of the present invention. Two canted horns 202 and 204 are arranged in a sum-difference horn configuration and are combined with an integral hybrid combiner (Magic-T) to produce sum-difference radiation patterns. The sum port 208 and the difference port 206 are arranged on top portion of the structure. Typically, port 208 is the difference port and port 206 is the sum port. However, since the E-field vector is now horizontal, the sum and difference ports are reversed, as explained in more detail below.

Figure 2B:
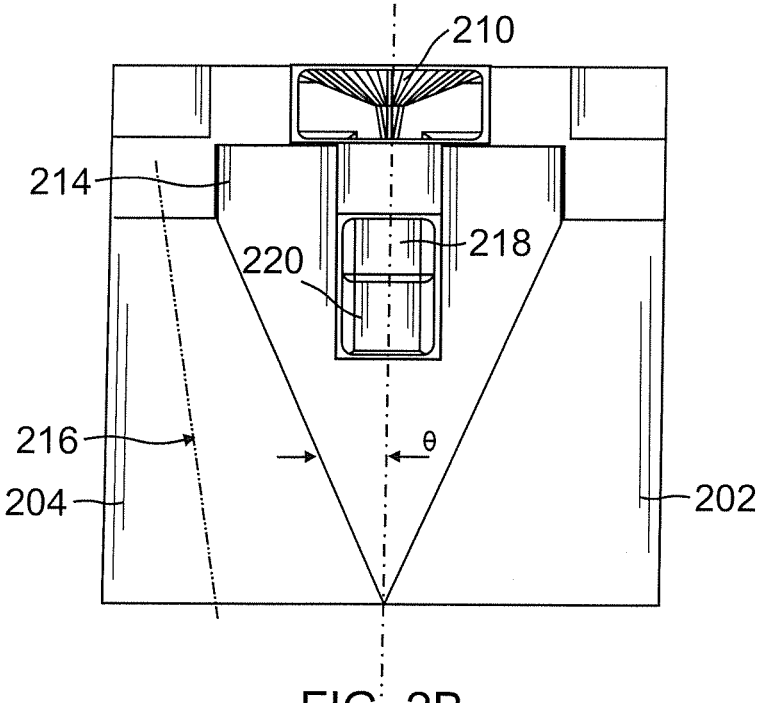
FIG. 2B is a schematic top view of two canted miniature antennas and the associated waveguide and porting structure, according to some embodiments of the present invention.

FIG. 2B is a schematic top view of two canted miniature antennas and the associated waveguide and porting structure, according to some embodiments of the present invention. As shown, the two horns 202 and 204 are canted and joint in at the front of the assembly forming an unused space 214 in between. The center line 216 of each canted horn is at angle (canted angle) with the side of the respective horn and the edge of the assembly. In some embodiments, the canted angle is about 10 degrees. Likewise, the centerline of the whole assembly is at an angle θ with the center line 216 of each canted horn. In some embodiments, the angle θ is about 18 degrees. The matching section of the splitter-combiner 210 is positioned in such a way that its apex points to the front (apertures) of the antenna structure and into the adjoining sum port. Item 218 is the bottom E-plane of the sum port that feeds the Magic-T (after a right angle bend from the sum input port 208, FIG. 2A). Item 220 of FIG. 2B is the right angle transition of the H-plane bent to the sum input port.

Figure 2C:
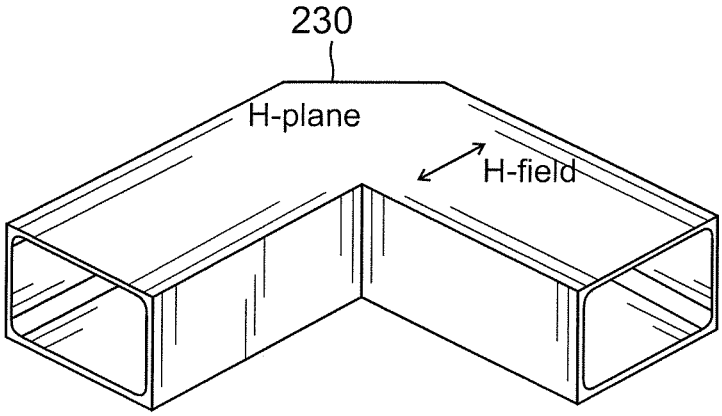
FIG. 2C is a perspective view of a H-plane right angle waveguide bend, according to some embodiments of the present invention.

FIG. 2C is a perspective view of the H-plane bend in the sum port waveguide feeding the Magic-T, according to some embodiments of the present invention. As shown, the waveguide has a 90 degree bend. The outer corner 230 of the bend is chamfered to maintain low standings waves, keeping the input port matching as close to unity as possible. In some embodiments, the chamfered edge 230 forms a 45 degree angle with the longitudinal axes of its two sides.

Figure 2D:
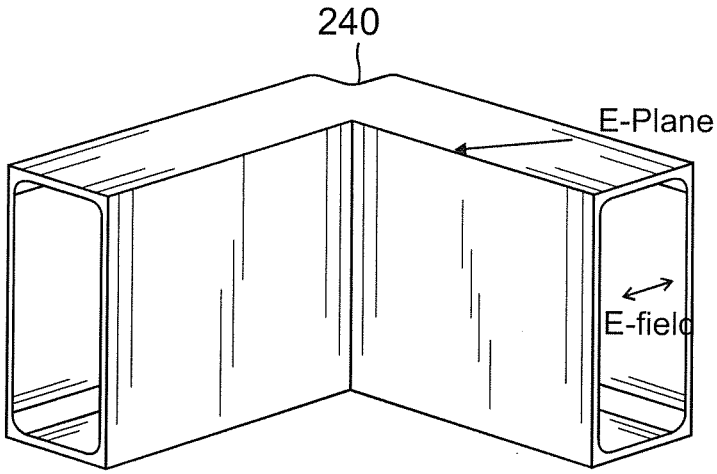
FIG. 2D is a perspective view of an E-plane right angle waveguide bend, according to some embodiments of the present invention.

FIG. 2D is a perspective view of the output portion of the Magic-T that feed the left and right horns. As shown, these waveguides have 90 degree bends. In this case, the right angle bend is in the E-plane of the waveguides and therefore, the outer corners 240 of the bend is formed as a "step" to maintain low standing waves and keeping the input port matching as close as possible to unity. In some embodiments, the length of the each two sides of the step 240 is about 1.7 mm.

Accordingly, two miniature canted pyramidal horns, which in some embodiments, produce up to 18 dB of gain, are used to provide a grating-lobe-free azimuth pattern. These two horns are fed from an internal (integrated with the antenna) hybrid combiner that allows for transmission of either a difference pattern or sum pattern depending on which input port is selected. In some embodiments, this entire antenna assembly is 1.14 cu. in. in volume and can be molded in plastic. In some embodiments, the entire antenna assembly is less than 1.15 cu. in. in volume. In some embodiments, the plastic is plated (metalized) to support the required antenna electromagnetic properties.

Figure 3A:
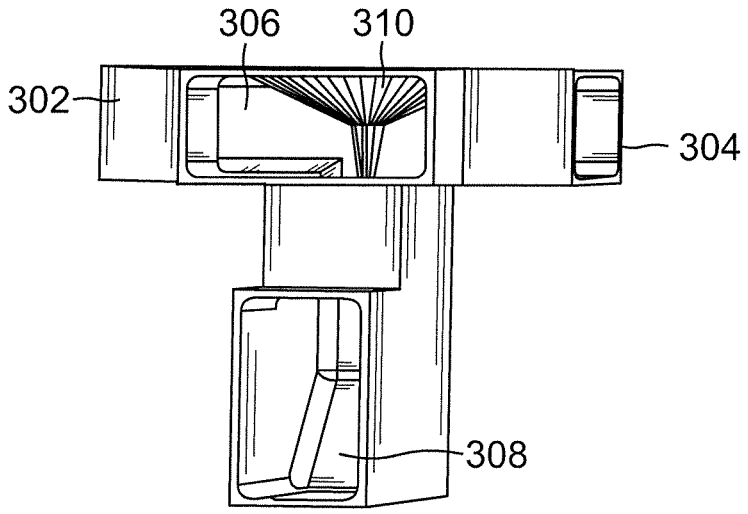
FIG. 3A is a simplified representation of a combiner positioned in a miniature antenna assembly, according to some embodiments of the present invention.

FIG. 3A is a simplified representation of a 180 degree hybrid combiner/splitter positioned in a miniature antenna assembly, according to some embodiments of the present invention. The matching section of the Combiner (Magic-T) 310 is positioned at the top portion at the edge of the assembly. On each side of the combiner there is an output port, 302 and 304 respectively, to the left aperture and the right aperture via e-plane bend (see, for example, FIG. 2D). The difference input port 306 is positioned on top of the combiner 310. The sum input port 308 is positioned so as to direct its wave energy to the apex of the combiner 310. Since the E-field vector is transverse to the minimum waveguide dimension, according to the above described embodiments, the sum and difference ports of the above embodiments are reversed, as described above. That is, due to the fact that waveguide bends are E-plane bends, the typical sum port now functions as the difference port and vise-versa. However, in some embodiments, for a 180 degree hybrid combiner that does not have an 90 degree bends associated with the ports, the sum and difference input port designations are normally reversed from what is indicated is the above-described embodiments. This is further explained later in reference to FIGS. 5A and 5B.

Figure 3B:
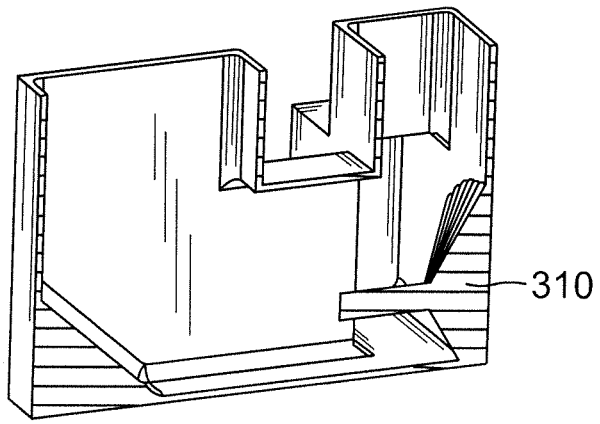
FIG. 3B is a cross sectional view of input ports in a miniature antenna assembly, according to some embodiments of the present invention.

FIG. 3B is a cross sectional view of input ports in a miniature antenna assembly, according to some embodiments of the present invention. As shown, the matching section of the combiner 310 is positioned as an impedance matching structure on one edge of the antenna assembly. The cone structure with its attendant spire 310 (FIGS. 3A and 3B) are, and have been, referred to as the matching section of the Magic-T. This cone structure is offset in a manner relative to the central axes of the two output ports and input sum port. This offset is necessary to keep standing waves within the combiner structure to a minimum.

Figure 4:
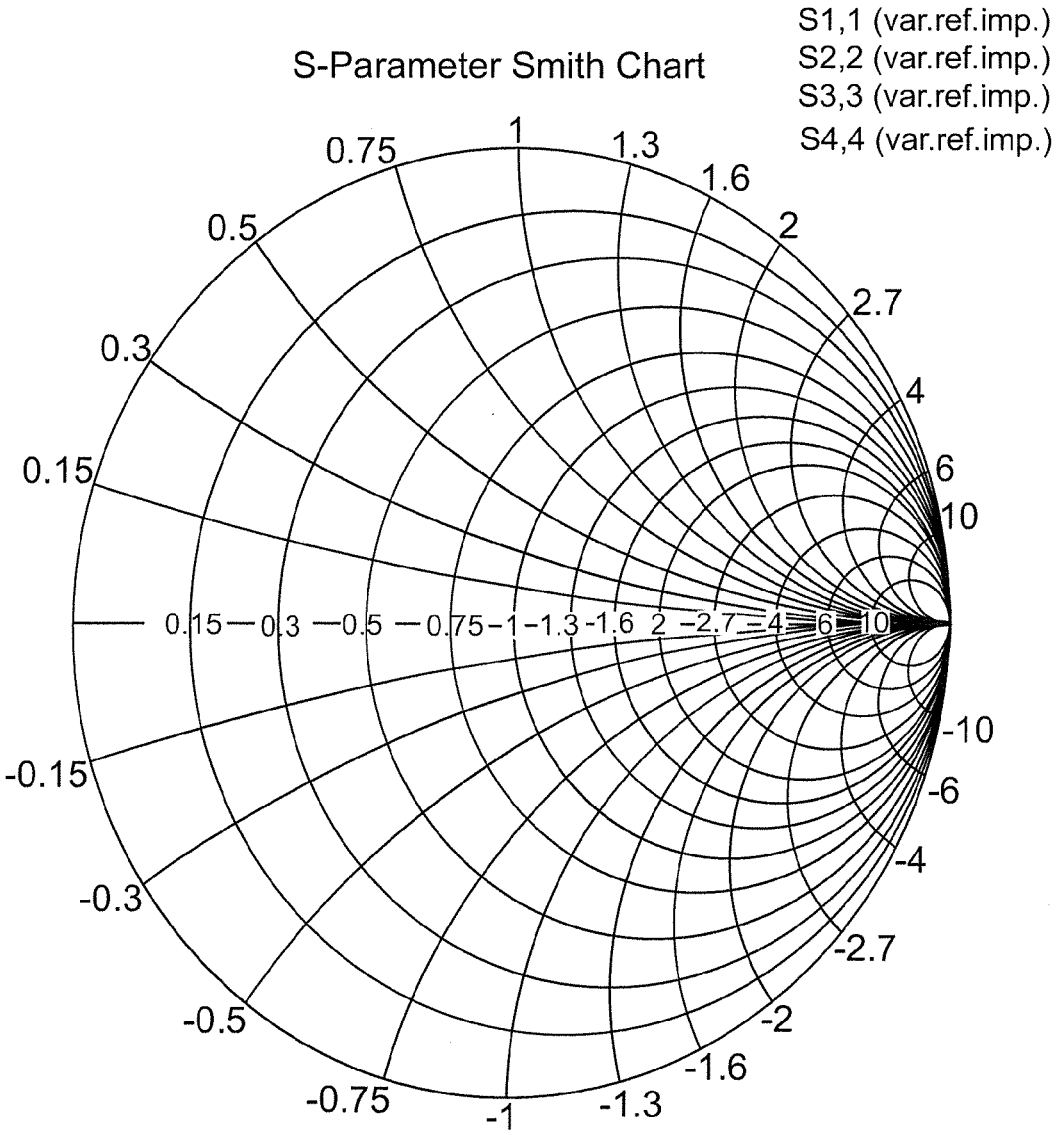
FIG. 4 is an S-Parameter Smith chart of the combiner/splitter, according to some embodiments of the present invention.

FIG. 4 is an S-parameter Smith chart of a miniature antenna assembly, according to some embodiments of the present invention. As shown the standing wave voltage ratio (VSWR) is less that 1.35:1.00 for all four of the ports and thus the combiner is well matched. The employment of the slanted H-plane bend in the sum input port and the stepped E-plane bends in the combiner output ports along with the positioning of the matching section of the Magic-T all contribute to the low input port VSWR's shown in FIG. 4. Also, input port isolation (sum to difference) is less than −50 dB and the output to either input port isolation is less than −90 dB.

Figure 5B:
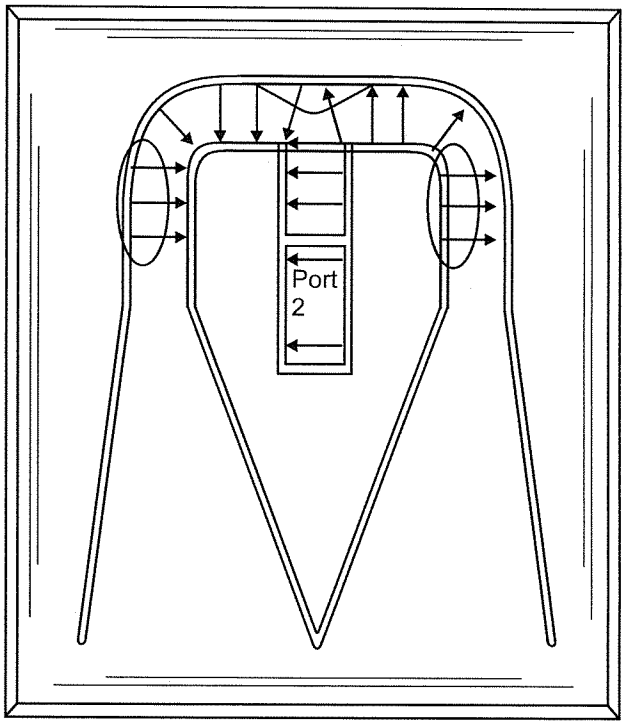
FIGS. 5A and 5B illustrate the phase reversal of the input ports, according to some embodiments of the present invention.
Figure 5A:
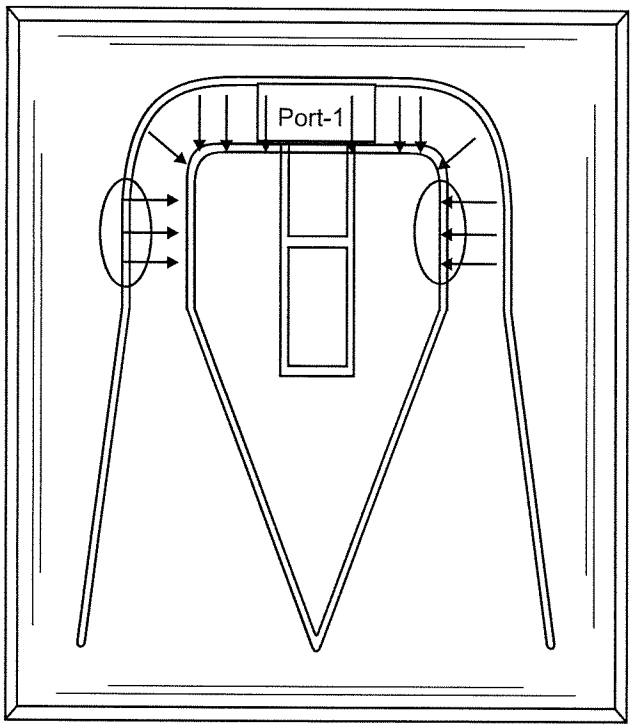

FIGS. 5A and 5B illustrate the phase reversal of the input ports, according to some embodiments of the present invention. In FIG. 5A, port 1 is fed in for example, a TE-10 mode and the corresponding E-field vectors are shown. Port 1 is typically the Magic-T sum port. However, in this case, since there is an E-filed phase reversal due to 90 degree bends, port 1 is now the Magic-T difference port. Similarly, in FIG. 5B, port 2 is fed in TE-10 mode and the corresponding E-field vectors are shown. Port 2 is typically the difference port. However, in this case, since there is an E-filed phase reversal due to 90 degree bends, port 2 is now the sum port.

Figure 6:
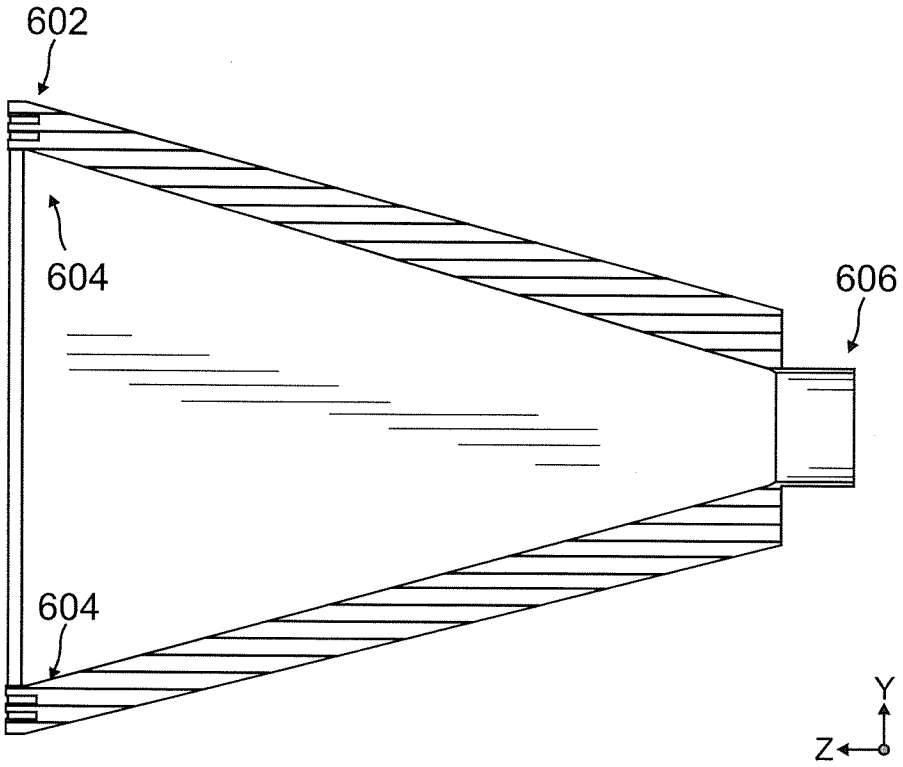
FIG. 6 is cross section view of an exemplary horn including a plurality of grooves for back lobe suppression, according to some embodiments of the present invention.

FIG. 6 is cross section view of an exemplary horn including a plurality of grooves for back lobe suppression, according to some embodiments of the present invention. For this example, the feed 606 is oriented with a vertical H-plane and horizontal E-plane. A plurality of grooves 602 (two in this case) having a ¼ wavelength are formed around the aperture opening 604. In some embodiments, at the aperture of the horn, the conductive material of the horn is increased in thickness to accommodate one or more annular groove that are extended one-quarter wavelength into the conductive horn material at the radiating aperture. The result is to suppress any surface current emanating from the waveguide portion of the horn. By suppressing waveguide surface currents from reaching the outer conducting surface of the horn antenna, unwanted RF radiation is also suppressed. In some embodiments, the plurality of grooves 602 comprises two choke grooves spaced 0.50 mm apart from the aperture and from each other. Each groove is 0.50 mm wide and is about 2 mm (¼ wavelength) deep. In some embodiments, the axial length of the horn is about 50 mm and the aperture opening 604 is about 14 mm×34 mm with the vertical dimension being the larger dimension.

Simulation results for three different horns, one with no grooves, one with one groove and the last one with two grooves, show that the forward gain is slightly increased and back side lobes are suppressed with the addition of annular grooves at the horn's aperture. The ¼ wavelength depth of each groove forms a high impedance barrier to the outer surface currents present on the horn radiator. This is an effective method of suppressing back scatter radiation. One groove suppresses rear-ward radiation by approximately 6 dB, while two annular rings suppress back radiation by approximately 10 dB.

Figure 7A:
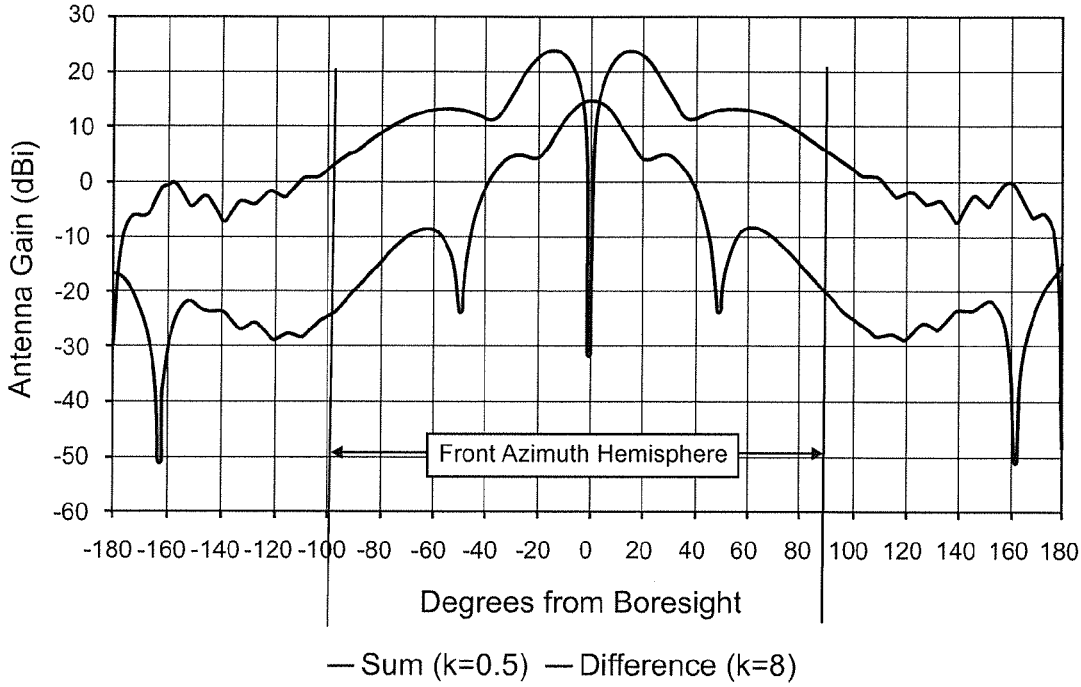
FIG. 7A is a graph depicting azimuth discrimination capabilities of some embodiments of the present invention.

FIG. 7A is a graph depicting azimuth discrimination capabilities of some embodiments of the present invention. Here, kΔ is selected to be 8 and kΣ is selected to be 1. Interrogator azimuth discrimination needs to be sufficiently narrow to keep unintended transponders from responding. On the other hand, the azimuth discrimination beamwidth cannot be so small as to not fully illuminate (i.e. "cover") the desired transponder (vehicle) being targeted. Accordingly, interrogator side-lobe suppression (ISLS) between the transponder replies received outside of the interrogator's field of view (FOV) may be used. Typically this is accommodated by using an Omni antenna as described shortly. When the antenna assembly of the present invention is configured to radiate a sum pattern, basic directivity is established by the radiated sum pattern. When the antenna assembly is configured to radiate a difference pattern, a radiation null is observed to exist in the array's bore-sight aiming direction.

Furthermore, via signal processing techniques, the received sum signal and the independently received difference signal can be artificially multiplied during the detection process, prior to making the sum/difference comparison. This is referred to in Combat ID practice as the use of k-factors. By assigning a k-factor of 8 to the difference pattern and a k-factor of 0.5 to the sum pattern, incursions of the difference pattern into the sum pattern at angles off of boresight (0 degree region in FIG. 7A) are eliminated. This is how interrogator side-lobe suppression (ISLS) is accomplished with this invention. It is only at the boresight, that the sum pattern will be high relative to the difference pattern. As shown, there are no difference pattern re-entries into the sum pattern, except at the anterior of the antenna structure.

Typically, the use of an Omni antenna for ISLS in conjunction with sum and difference sets of radiation patterns will provide a means to keep these ISLS incursions from occurring (other than at the boresight). With this antenna (this invention), by employing the use of k-factors mentioned above, the need for the Omni ISLS antenna is eliminated. Only a sum and difference pattern need to be transmitted. This reduces system costs and make the system compatible with other CID systems that use an omni antenna.

Figure 7B:
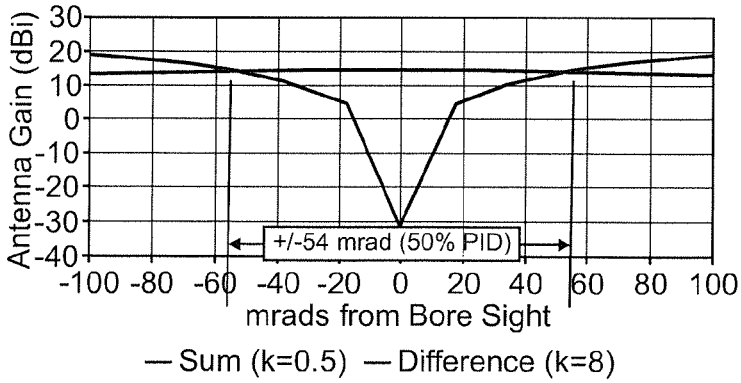
FIG. 7B is a graph illustrating a discrimination region for the graph of FIG. 7A.

FIG. 7B is a graph illustrating a discrimination region for the graph of FIG. 7A. The discrimination region about the boresight shows where the difference pattern is less than the sum pattern. The horizontal axis is expressed in milli-Radians. Note that at +/−54 mRad, the sum and difference patterns are equal and beyond these limits, the difference pattern exceeds the sum pattern. As shown, a positive identification occurs within the region +54>0>−54 mRad.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A miniature interrogator antenna assembly comprising:
- a housing;
- a first miniature horn antenna in the housing having a first aperture;
- a second miniature horn antenna in the housing having a second aperture, wherein the first and second miniature horn antennas are arranged in a canted configuration and are joint at a front of the assembly, and wherein the first and second apertures form a combined aperture at the front of the assembly;
- a splitter/combiner having a cone-shaped or pyramid-shaped matching portion positioned at a top edge of the housing opposite to the front of the assembly in such a way that an apex of the cone-shaped or pyramid-shaped matching portion points to the front of the assembly;
- a plurality of annular grooves formed around the combined aperture at the front of the assembly;
- a sum input port formed on top of the assembly and coupled to a first waveguide with an H-plane bend feeding the splitter/combiner; and
- a difference input port formed on top of the assembly and coupled to a second waveguide feeding the splitter/combiner directly,
- wherein the miniature interrogator antenna assembly is configured to transmit, through the combined aperture of the first and second miniature horn antennas, a sum pattern when the sum input port is selected and a difference pattern when the difference input port is selected, and wherein the front of the assembly comprises of substantially only the first aperture, the second aperture and the plurality of annular grooves.

2. The miniature interrogator antenna assembly of claim 1, wherein the housing is substantially in a shape of a cube.

3. The miniature interrogator antenna assembly of claim 2, wherein the antenna assembly has a volume of approximately 1.14 Cu. in.

4. The miniature interrogator antenna assembly of claim 1, wherein the antenna assembly is molded in plastic, and wherein the plastic is metalized.

5. The miniature interrogator antenna assembly of claim 1, wherein a centerline of each canted miniature horn antennas is at a canted angle of about 10 degrees with a side of a respective miniature horn antenna and an edge of the housing.

6. The miniature interrogator antenna assembly of claim 1, wherein a centerline of the antenna assembly is at an angle of about 18 degrees with a centerline of each canted miniature horn antennas.

7. The miniature interrogator antenna assembly of claim 1, wherein the plurality of annular grooves comprises two grooves.

8. The miniature interrogator antenna assembly of claim 1, wherein each of the plurality of annular grooves has a depth of one quarter of a wavelength of the transmitted pattern and has a spacing of about 0.5 mm from a next annular groove.

9. The miniature interrogator antenna assembly of claim 1, further comprising a first output port on a first side of the splitter/combiner and a second output port on a second side of the splitter/combiner opposite to the first side, wherein the first and second apertures are respectively coupled to the first and second output ports of the combiner via waveguides with an E-plane 90 degree bend.

10. The miniature interrogator antenna assembly of claim 1, wherein the sum input port and the difference input port are formed on a top of the housing.

11. The miniature interrogator antenna assembly of claim 1, wherein an unused space is formed between the first and second miniature horn antennas in the housing towards a back of the housing.

12. A miniature interrogator antenna assembly comprising:

a housing;

a first miniature horn antenna in the housing having a first aperture;

a second miniature horn antenna in the housing having a second aperture, wherein the first and second miniature horn antennas are arranged in a canted configuration and are joint at a front of the assembly, and wherein the first and second apertures form combined apertures at the front of the assembly;

a splitter/combiner having a cone-shaped or pyramid-shaped matching portion, wherein the matching portion is positioned in the housing in such a way that an apex of the matching portion points to the front of the assembly;

a selectable sum input port formed on top of the assembly and coupled to the splitter/combiner; and a selectable difference input port formed on top of the assembly and coupled to the splitter/combiner directly, wherein the miniature interrogator antenna assembly is configured to transmit, through the combined aperture of the first and second miniature horn antennas, a sum pattern when the sum input port is selected and a difference pattern when the difference input port is selected, and wherein the front of the assembly comprises of substantially only the first aperture and the second aperture.

13. The miniature interrogator antenna assembly of claim 12, further comprising a plurality of annular grooves formed around the combined apertures at the front of the assembly.

14. The miniature interrogator antenna assembly of claim 12, wherein the housing is substantially in a shape of a cube.

15. The miniature interrogator antenna assembly of claim 12, wherein the antenna assembly is molded in plastic, and wherein the plastic is metalized.

16. The miniature interrogator antenna assembly of claim 13, wherein the plurality of annular grooves comprises two grooves.

17. The miniature interrogator antenna assembly of claim 16, wherein each of the two annular grooves has a depth of one quarter of a wavelength of the transmitted pattern and has a spacing of about 0.5 mm from a next annular groove.

18. The miniature interrogator antenna assembly of claim 12, further comprising a first output port on a first side of the splitter/combiner and a second output port on a second side of the splitter/combiner opposite to the first side, wherein the first and second apertures are respectively coupled to the first and second output ports of the combiner via waveguides with an E-plane 90 degree bent.

19. The miniature interrogator antenna assembly of claim 12, wherein the sum input port coupled to the splitter/combiner via a waveguide with an H-plane bend feeding the splitter/combiner.

20. The miniature interrogator antenna assembly of claim 12, wherein a centerline of each canted miniature horn antennas is at a canted angle of about 10 degrees with a side of a respective miniature horn antenna and an edge of the housing.

* * * * *